US005810066A

United States Patent [19]

Knudsen et al.

[11] Patent Number: 5,810,066

[45] Date of Patent: Sep. 22, 1998

[54] SYSTEMS AND METHODS FOR CONTROLLING THE DIMENSIONS OF A COLD FINGER APPARATUS IN ELECTROSLAG REFINING PROCESS

[75] Inventors: Bruce Alan Knudsen, Amsterdam; Robert John Zabala, Schenectady; Mark Gilbert Benz, Burnt Hills; William Thomas Carter, Jr., Galway; Paul Leonard Dupree, Scotia, all of N.Y.

[73] Assignee: General Electric Company, Schenectady, N.Y.

[21] Appl. No.: 576,793

[22] Filed: Dec. 21, 1995

[51] Int. Cl.[6] ..... B22D 23/10; B22F 9/08; C22B 9/18

[52] U.S. Cl. ..... 164/46; 164/493; 164/497; 164/513; 164/515; 75/10.24; 266/201

[58] Field of Search ..... 164/470, 471, 164/493–497, 507–509, 513–515, 337, 437, 46; 75/10.1, 10.11, 10.24; 266/201, 202; 222/606, 607; 373/72, 78, 79, 115, 156

[56] References Cited

U.S. PATENT DOCUMENTS 5,160,532 11/1992 Benz et al. .
5,310,165 5/1994 Benz et al. ..... 266/202
5,348,566 9/1994 Sawyer et al. ..... 164/53
5,366,204 11/1994 Gigliotti, Jr. et al. ..... 266/202

FOREIGN PATENT DOCUMENTS 60-216972 10/1985 Japan ..... 164/337
4-157051 5/1992 Japan ..... 222/606

*Primary Examiner*—Kuang Y. Lin
*Attorney, Agent, or Firm*—Noreen C. Johnson; Douglas E. Stoner

[57] ABSTRACT

A system and method of electroslag refining of metal is taught. The system and method includes the introduction of unrefined metal into an electroslag refining process in which the unrefined metal is first melted at the upper surface of the refining slag. The molten metal is refined as it passes through the molten slag. The refined metal is collected in a cold hearth apparatus having a skull of refined metal formed on the surface of the cold hearth for protecting the cold hearth from the leaching action of the refined molten metal. A cold finger bottom pour spout is formed at the bottom of the cold hearth to permit dispensing of molten refined metal from the cold hearth. The dimensions of the cold finger apparatus pour spout are controlled by positioning a retaining means around the outer surface of the pour spout thereby controlling the flow rate of molten metal through the cold finger apparatus.

14 Claims, 5 Drawing Sheets

SYSTEMS AND METHODS FOR CONTROLLING THE DIMENSIONS OF A COLD FINGER APPARATUS IN ELECTROSLAG REFINING PROCESS

BACKGROUND OF THE INVENTION

The present invention relates generally to control of the flow of refined metal in an ESR-CIG system. The ESR apparatus is an electroslag refining apparatus and the CIG apparatus is a cold wall induction guide tube apparatus, also referred to herein as a cold wall induction guide mechanism and a cold finger nozzle mechanism. More particularly, the invention relates to controlling the flow of liquid metal to, through and from (as a metal stream) the CIG apparatus. Most specifically, it relates to controlling the inner dimension of the cold finger nozzle mechanism orifice.

Such control of the outer orifice dimensions is important to numerous applications which can be made of the refining apparatus including atomization processing and relates generally to direct processing of metal passing through an electroslag refining operation. One example of molten metal refining is referred to as electroslag refining, and is illustrated and described in U.S. Pat. No. 5,160,532—Benz et al, assigned to the same assignee as the present invention, the disclosure of which is hereby incorporated by reference.

In an electroslag process, a large ingot of a preferred metal may be effectively refined in a molten state to remove important impurities such as oxides and sulfides which may have been present in the ingot. Simply described, electroslag refining comprises positioning a metal ingot over a pool of molten material in a suitable vessel or furnace where the molten material pool may include a surface layer of solid slag, an adjacent underlayer of molten slag and a lowermost body of refined molten ingot metal. The ingot is connected as an electrode in an electrical circuit including the molten metal pool, a source of electrical power and the ingot. The ingot is brought into contact with the molten slag layer and an electrical current is caused to flow across the ingot/molten slag interface.

This arrangement and process provides electrical resistance heating of the slag and melting of the ingot at the noted interface with the molten ingot metal passing through the molten slag layer as a refining medium to become a part of the body of refined ingot metal. It is the combination of controlled resistance melting and passage of the molten ingot metal through the molten slag layer which refines the ingot metal to remove impurities such as oxides, sulfides, and other undesirable inclusions.

Spray forming is a process using gas atomization to produce a spray of droplets of liquid metal followed by solidification of the spray on a solid body to directly form a billet or billet preform. In metal spray forming, a small stream of refined molten metal from the furnace is directed to pass through a molten metal spray forming atomizer generally comprising a closed peripheral manifold about a central aperture. The manifold may be equipped with gas inlet means and plural gas jet exit means. A gas under pressure is supplied to the manifold to exit through the gas jets in converging streams which impinge the passing metal stream to convert or break up the metal stream into a generally expanding spray pattern of small molten metal droplets. This spray pattern is caused to impinge and deposit on a suitable collector surface to generate a metal billet or other metal object.

An important variable in this process is the gas-to-metal ratio (GMR) which indicates the amount of atomization gas relative to the amount of molten metal which is required to effectively atomize the metal stream to form a spray and to cool the spray in-flight before striking the billet or preform. The spray is scanned across a revolving substrate to build a uniform layer. As it becomes necessary to enlarge the diameter of the preform, it becomes increasingly necessary to control the local temperature of the spray. A relatively hotter spray is desired near the outer diameter of the preform, a relatively cooler spray is desired at the centerline of the preform.

Best results are believed obtained when the molten metal spray pattern from the atomization zone is directed angularly against the collector or preform object rather than perpendicular. An angular impingement provides improved deposition efficiency as well as improved preform metal density and microstructure.

One of the critical components of the ESR/CIG melting system, the copper funnel that forms the walls of the cold-walled-induction guide which comprises several copper segments that result from slotting an otherwise axisymmetric funnel, the slots being added to avoid melting the copper funnel itself as a result of the surrounding induction coils and to allow penetration of the electric field into the metal stream, has been found to experience a high level of thermal and mechanical strain related to the onrush of liquid metal that occurs when the ESR-CIG system is started. This thermal and mechanical strain has resulted in dimensional changes in the orifice of the cold-induction guide and thus, have resulted in unacceptable changes in the diameter of the orifice which have impacted the accurate control of the liquid metal pouring rate or flow rate exiting the orifice and entering the atomization zone.

Thus, it is important to develop methods and systems for maintaining dimensional control of the orifice at all times so that methods and systems for varying the molten metal flow rate to the atomization zone while maintaining the rate of delivery of the atomizing gas to the molten metal stream constant in order to control the gas to metal ratio (GMR) of the atomization zone will be effective. Such methods and systems for maintaining dimensional control of the orifice at all times could include, among other means, providing a retaining ring to the outer diameter of the CIG nozzle to prevent dimensional changes in the orifice. Such ring should comprise any non-conductive material, such as plastic, thermosetting resin, etc., and optionally a fiber reinforced composite material to achieve the required stiffness.

SUMMARY OF THE INVENTION

In one of its broader aspects, the present invention includes systems for controlling the flow of melt from a cold wall induction guide tube mechanism comprising: a funnel shaped cold wall induction guide tube mechanism including an exit orifice having dimensions; a skull of melt operatively formed in the mechanism; a reservoir of melt above the mechanism; a stream of melt exiting the exit orifice of the mechanism; means, operatively positioned relative to the mechanism, for controlling the dimensions of the exit orifice during the flow of the stream therefrom thereby controlling the rate of the flow of melt from the mechanism.

Another aspect of the present invention includes methods for controlling the flow of melt from a cold wall induction guide tube mechanism comprising the steps of: providing a funnel shaped cold wall induction guide tube mechanism having outer walls;

providing a reservoir of melt above the funnel shaped mechanism; providing a flow of melt to and down through the funnel shaped mechanism to form a stream of melt exiting the neck portion of the funnel shaped mechanism; and controlling the position of the outer walls of the funnel shaped mechanism such that the rate of the flow of melt from the mechanism is controlled.

It is, accordingly, one object of the present invention to provide systems and methods for controlling the dimensions of the cold finger apparatus pour spout by positioning a retaining means around the outer surface of the pour spout thereby controlling the flow rate of molten metal through the cold finger apparatus.

Other objects and advantages of the invention will be apparent from the following description, the accompanying drawings and the appended claims.

DETAILED DESCRIPTION OF THE INVENTION

In carrying out the present invention, an electrode or ingot of metal to be refined is introduced directly into an electroslag refining apparatus for refining the metal and produce a melt of refined metal which is received and retained within a cold hearth apparatus mounted immediately below the electroslag refining apparatus. The molten metal is dispensed from the cold hearth through a cold finger orifice mounted directly below the cold hearth reservoir. The flow of melt from the cold finger apparatus is controlled by one or by a combination of mechanisms including thermal and electro-mechanical means.

If the rate of electroslag refining of metal and accordingly the rate of delivery of refined metal to a cold hearth approximates the rate at which molten metal is drained from the cold hearth through the cold finger orifice, an essentially steady state operation is accomplished in the overall apparatus and the process can operate continuously for an extended period of time and, accordingly, can process a large bulk of unrefined metal to refined metal.

The processing described herein is applicable to a wide range of alloys which can be processed beneficially through the electroslag refining processing. Such alloys include nickel- and cobalt-based superalloys, zirconium and titanium-based alloys, and ferrous-based alloys, among others. The slag used in connection with such metals will vary with the metal being processed and will usually be the slag conventionally used with a particular metal in the conventional electroslag refining thereof.

The several processing techniques may be combined to produce a large body of refined metal because the ingot which can be processed through the combined electroslag refining and cold hearth and cold finger mechanism can be a relatively large supply ingot and can, accordingly, produce a continuous stream of metal exiting from the cold finger orifice over a prolonged period to deliver a large volume of molten metal.

Figure 1:
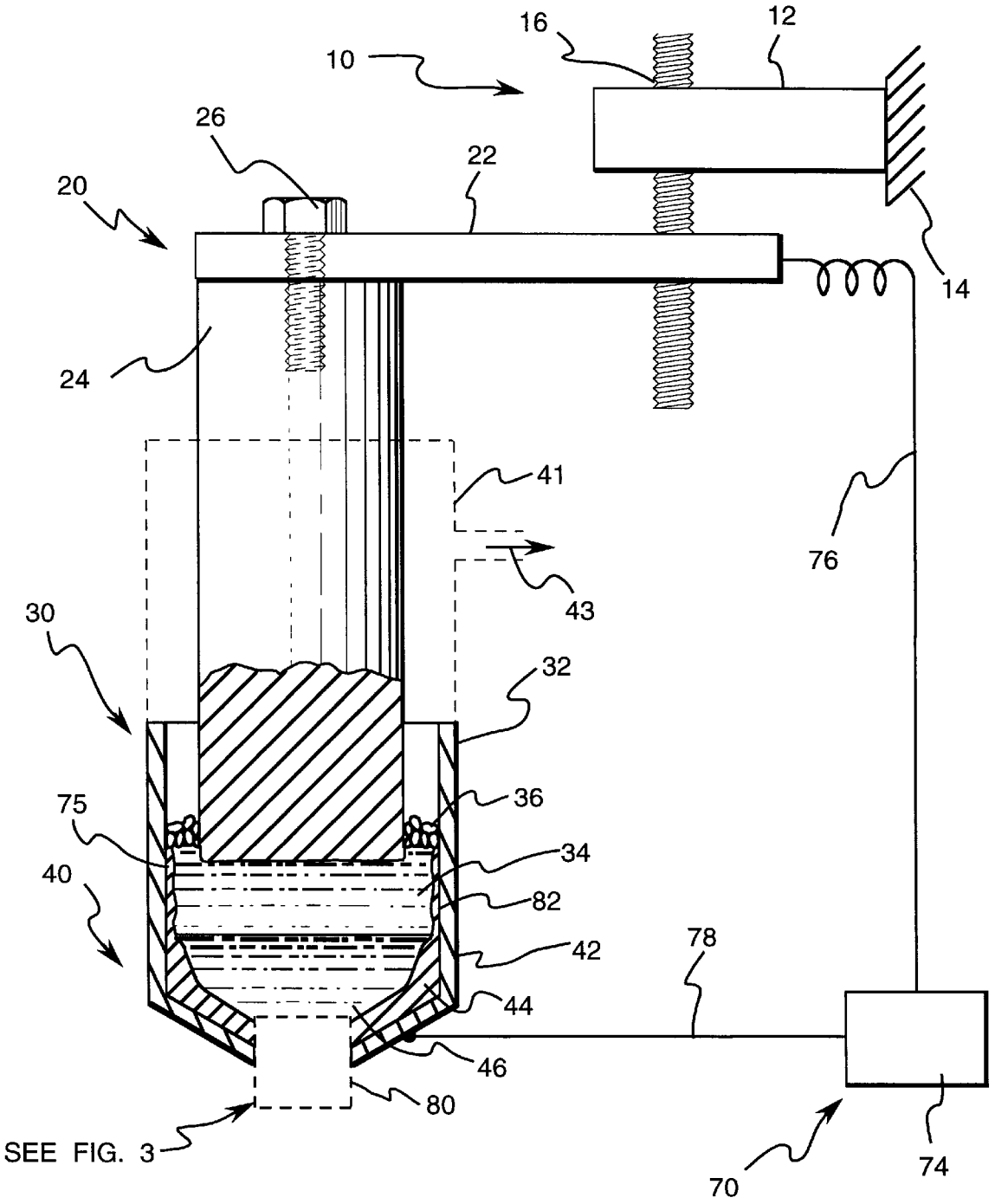
FIG. 1 is a semischematic vertical sectional view of a representative electroslag refining apparatus suitable for use with the present invention.
Figure 2:
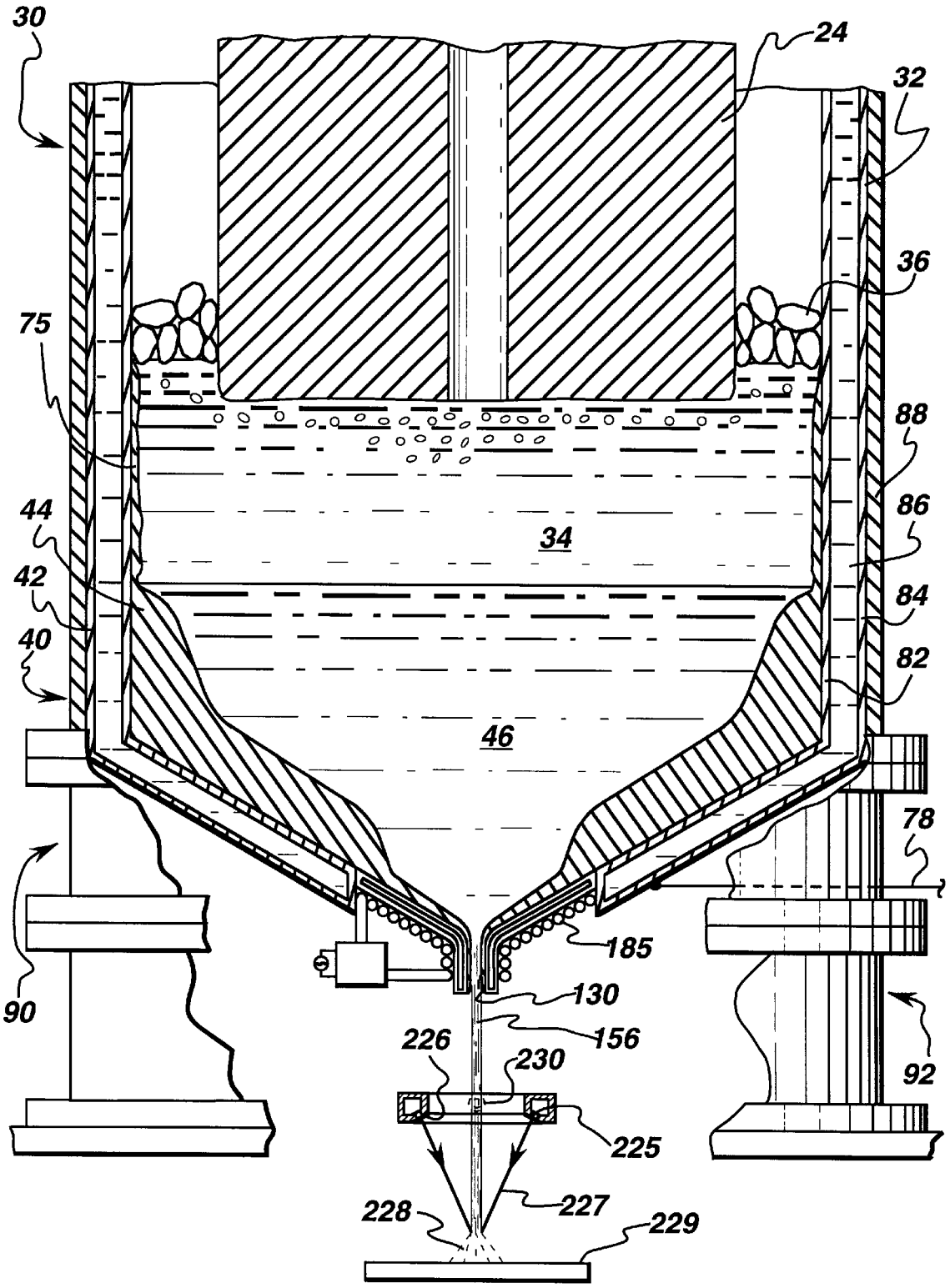
FIG. 2 is a semischematic vertical sectional representative illustration of the apparatus of FIG. 1 but showing structural details of the cold wall induction guide tube and the atomizer.

FIGS. 1 and 2 are semischematic elevational views in part in section of a number of the essential and auxiliary elements of apparatus for carrying out the electroslag refining and atomization aspects of the present invention. A vertical motion control apparatus 10 is shown schematically. It includes a structure 12 mounted to a vertical support 14 for containing a motor or other mechanism adapted to impart rotary motion to a member 16 for example, for illustrative purposes only, a screw or screw mechanism. An ingot support station 20 comprising means 22, such as, for illustrative purposes only, a bar, threadedly engaged at one end to the member 16 and supporting the ingot 24 at the other end by conventional means 26, for example, for illustrative purposes only, a bolt. It being understood that the present illustration is representative in nature only and that in an industrial setting pneumatic, electronic and other well-known methods and apparatus would actually be used, as is known in the art.

An electroslag refining station 30 comprises a cooled, such as, for example, by water, reservoir 32 containing a molten slag 34, an excess of which is illustrated as solid slag granules 36. A skull of slag 75 may form along the inside surfaces of the inner wall 82 of vessel 32 due to the cooling influence of the cooling water flowing against the outside of inner wall 82.

A cold hearth station 40 is mounted immediately below the electroslag refining station 30 and includes a cooled, such as, for example, by water, hearth 42 containing a skull 44 of solidified refined metal and also a body 46 of liquid refined metal. Cooled reservoir 32 may be formed integrally with the cooled hearth 42.

The bottom dispensing structure (shown as an empty dashed box) 80 of the apparatus is provided in the form of a cold finger orifice. The cold hearth dispensing station 80 and the cold finger orifice will be explained more fully below.

Electric refining current is supplied by station 70. The station includes the electric power supply and control mechanism 74. It also includes the conductor 76 carrying current to the bar 22 and, in turn, to ingot 24. Conductor 78 carries current to the metal vessel wall 32 to complete the circuit of the electroslag refining mechanism.

As illustrated by FIG. 2, the station 30 is an electroslag refining station disposed in the upper portion 32 of the vessel and the cold hearth station 40 is disposed in the lower portion 42 of the vessel. The vessel is preferably a double walled vessel having an inner wall 82 and an outer wall 84. Between these two walls, a cooling liquid, such as, for example, water is provided, as is conventional practice with some cold hearth apparatus. The cooling liquid 86 may be flowed to and through the flow channel between the inner wall 82 and outer wall 84 from supply means and through conventional inlet and outlet means which are conventional and which are not illustrated in the figures. The use of cooling liquid 86 to provide cooling to the walls of the cold hearth station 40 is necessary in order to provide cooling at the inner wall 82 and thereby to cause the skull 44 to form on the inner surface of the cold hearth structure.

The cooling liquid 86 is not essential to the operation of the electroslag refining or to the upper portion of the electroslag refining station 30 but such cooling may be provided to ensure that the liquid metal 46 will not make contact with the inner wall 82 of the containment structure because the liquid metal 46 could attack the wall 82 and cause some dissolution therefrom to contaminate the liquid metal of body 46 within the cold hearth station 40. Also, in FIG. 2, a structural outer wall 88 is also illustrated. Such an outer wall may be made up of a number of flanged tubular sections 90, 92.

Figure 3:
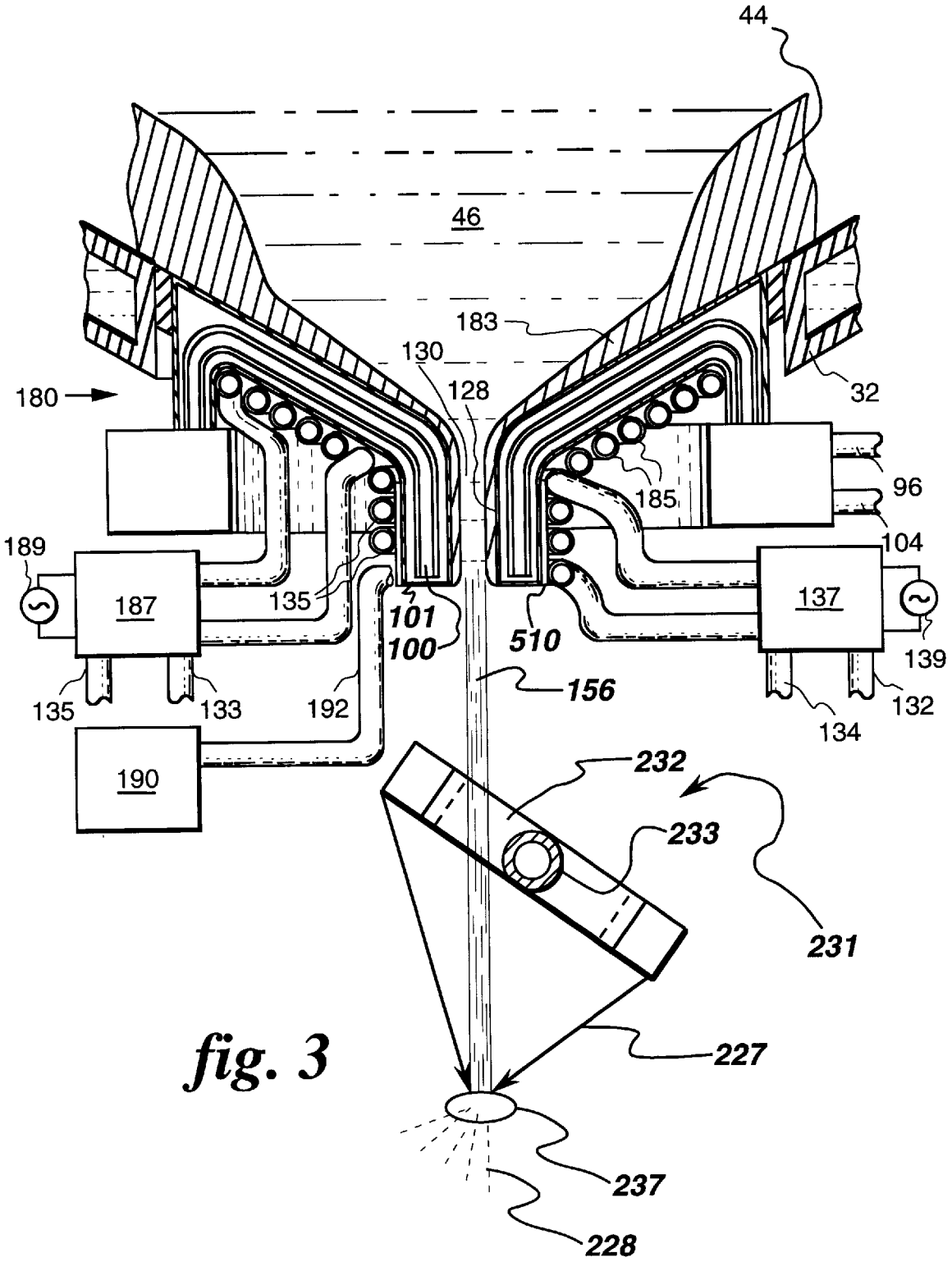
FIG. 3 is a semischematic vertical section in detail of the cold finger nozzle and atomizer of the structures of FIG. 2.
Figure 4:
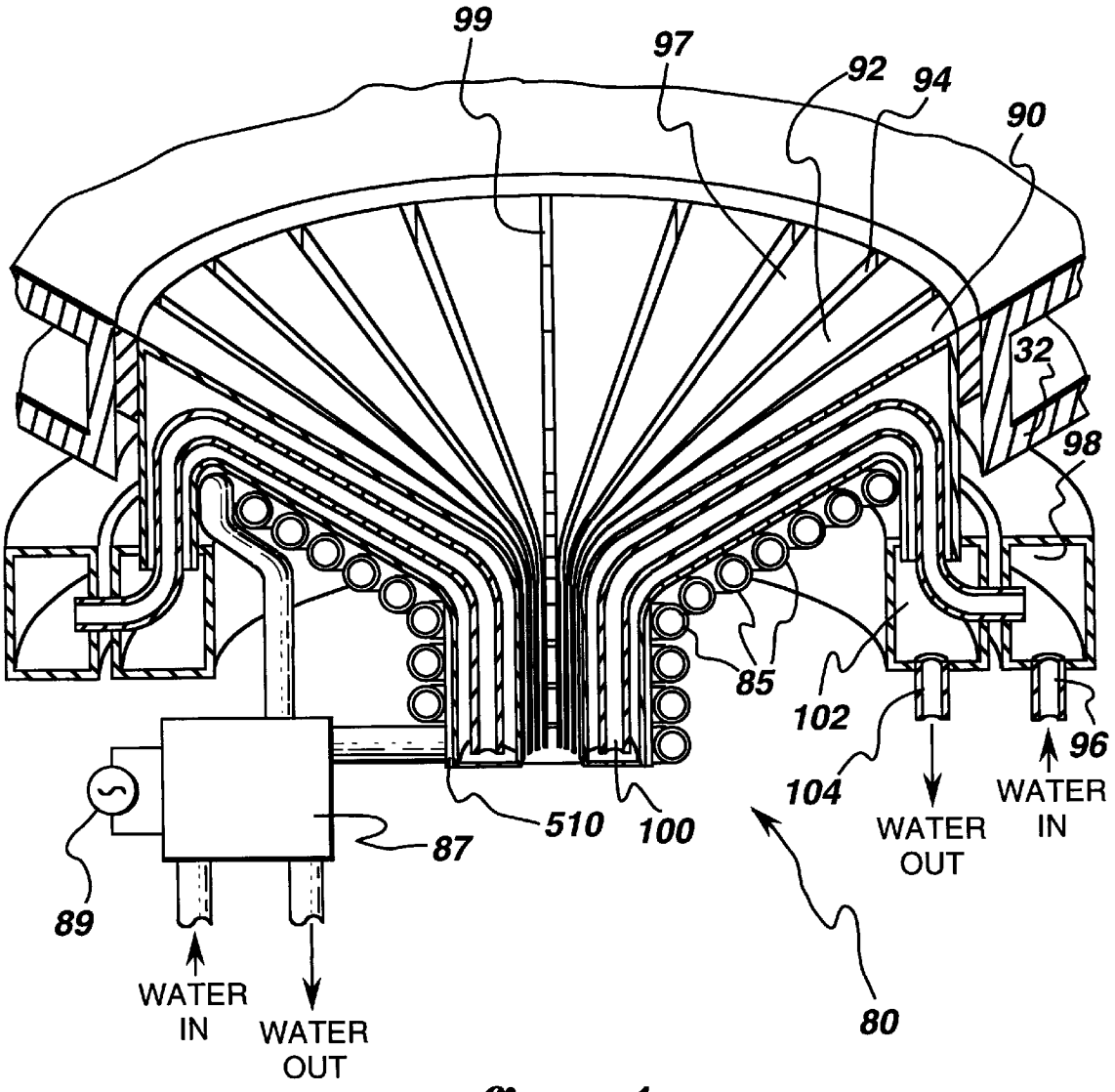
FIG. 4 is a semischematic illustration in part in section of the cold finger nozzle portion of an apparatus similar to that illustrated in FIG. 3 but showing the apparatus free of molten metal.

The cold finger structure is shown in detail in FIG. 3 in its relation to the processing of the metal from the cold hearth structure and the delivery of liquid melt 46 from the cold hearth station 40, as illustrated in FIGS. 1 and 2. FIG. 3 shows the cold finger with the solid metal skull and with the liquid metal reservoir in place. By contrast, FIG. 4 illustrates the cold finger structure without the liquid metal, or solid metal skull in order that more structural details may be provided and clarity of illustration may be achieved. Cold finger structures are not themselves novel structures and have been described in the literature (see for example the discussion in U.S. Pat. No. 5,348,566).

One structure useful in the present invention combines a cold hearth with a cold finger orifice so that the cold finger structure effectively forms part, and in the illustration of FIG. 3, the center lower part, of the cold hearth. This combination preserves the advantage of the cold hearth mechanism by permitting the purified alloy to form a skull, by its contact with the cold hearth, and thereby to serve as a container for the molten version of the same purified alloy. In addition, the cold finger orifice structure of station 180 of FIG. 3 is employed to provide a more controllable generally funnel shaped skull 183 and particularly of a smaller thickness on the inside surface of the cold finger structure. As is evident from FIG. 3, the thicker skull 44 in contact with the cold hearth and the thinner skull 183 in contact with the generally funnel shaped cold finger structure are essentially continuous.

One reason why the skull 183 is thinner than 44 is that a controlled amount of heat may be put into the skull 183 and into the generally cone shaped portion of the liquid metal body 46 which is proximate the skull 183 by means of the induction heating coils 185. The induction heating coil 185 is cooled by flow of a cooling liquid, such as, for example, water through the coolant and power supply 187. Induction heating power supplied to the unit 187 from a power source 189 is shown schematically in FIG. 3.

One significant advantage of the cold finger construction of the structure of station 180 is that the heating effect of the induction energy penetrates through the cold finger structure and acts on the body of liquid metal 46 as well as on the skull structure 183 to apply heat thereto. This is one of the features of the cold finger structure and it depends on each of the fingers of the structure being insulated from the adjoining fingers by an air or gas gap or by an insulating material. Hence the term CIG or cold wall induction guide tube mechanism.

This arrangement is clearly illustrated in FIG. 4 where both the skull and the body of molten metal are omitted from the drawing for clarity of illustration. An individual cold finger 97, as shown in FIG. 4, is separated from the adjoining finger 92 by a gap 94, which may be provided with and filled with an insulating material such as a ceramic material or with an insulating gas. The molten metal held within the cold finger structure 80 does not leak out of the structure through the gaps such as 94 because the skull 82, as illustrated in FIG. 3, forms a bridge over the various cold fingers and prevents and avoids passage of liquid metal therethrough. As is evident from FIG. 4, all gaps extend down to the bottom of the cold finger structure. This is evident in FIG. 4 as gap 99 aligned with the line of sight of the viewer is slow to extend all the way to the bottom of cold finger structure 80. The actual gaps can be quite small and of the order of about 20 to about 50 mils so long as they provide good insulating separation of the fingers.

Because it is possible to control the amount of heating and cooling passing from the induction coils 185 to and through the cold finger structure of station 180, it is possible to adjust the amount of heating or cooling which is provided through the cold finger structure both to the skull 183 as well as to the generally cone shaped portion of the body 46 of molten metal in contact with the skull 183.

As shown in FIG. 4, the individual fingers such as 90 and 92 of the cold finger structure are provided with a cooling fluid such as water by passing water into the receiving pipe 96 from a source not shown, and around through the manifold 98 to the individual cooling tubes such as 100. Water leaving the end of tube 100 flows back between the outside surface of tube 100 and the inside surface of finger 90 to be collected in manifold 102 and to pass out of the cold finger structure through water outlet tube 104. This arrangement of the individual cold finger water supply tubes such as 100 and the individual separated cold fingers such as 90 is essentially the same for all of the fingers of the structure so that the cooling of the structure as a whole is achieved by passing water in through inlet pipe 96 and out through outlet pipe 104.

The net result of this action is best illustrated in FIG. 3 where a stream 156 of molten metal is shown exiting from the cold finger orifice structure. This flow is maintained when a desirable balance is achieved between the input of cooling water and the input of heating electric power to and through the induction heating coils 185 and 135.

The induction heating coils 85 of FIG. 4 show a single set of coils operating from a single power supply 87 supplied with power from the power source 89. In the structure of FIG. 3, two induction heating coils are employed, the first is placed adjacent the tapered portion of the funnel shaped cold finger device and supplies heat principally to the controllable skull 183. A power source 189 supplies power to power supply 187 and this power supply furnishes the power to the set of coils 185 positioned immediately beneath the tapered portion of the funnel shaped cold finger structure. A second power source 139 furnishes power to power supply 137 and power is supplied from the source 137 to a set of coils 135 which are positioned along the vertical down spout portion of the cold finger apparatus to permit a control of the flow of molten metal from bath 46 through the vertical portion of the cold finger apparatus.

An increase in the amount of induction heating through coil 135 (see FIG. 3) can cause a remelting of the solidified plug of metal in the vertical portion of the cold finger apparatus and a renewal of stream 156 of molten metal through passageway 130. When the stream 156 is stopped or slowed, there is a corresponding growth and thickness of the skull 128 in the vertical portion or neck of the funnel shaped cold finger apparatus.

The regulation of the amount of cooling water flowing to the cold finger apparatus itself as well as the flow of induction heating current through the coils 185 and 135 and particularly the coil 135 regulates the thickness of the thinner skull 128 and the thickness of skull 128 is one of several parameters which regulates the rate of flow of metal from the reservoir 46, thus having an effect on the gas to metal ratio during atomization prior to the spray forming of the preform.

A further increase in the amount of induction heating power through the coil 135 can cause a desired electromagnetic effect, namely the electromagnetic repulsion of the liquid metal stream away from the passageway 130. The electromagnetic restriction of the flow through the cold finger apparatus effectively results in an electromagnetic orifice that may be controlled and caused to fluctuate at high rates which in turn has the effect of enabling the flow rate of the stream therethrough to be rapidly varied, i.e. selectively increased or decreased. Thus, the power applied to the coil 135 has a direct influence on the rate of flow of metal from the reservoir 46, thus having a direct effect on the gas to metal ratio during atomization and subsequently on the spray 228 impacting the preform 229.

As mentioned above, when the rate of flow of metal from the cold hearth station 40 through the cold finger mechanism 180 is selectively increased or reduced, it is necessary to also increase or reduce the flow of the refining current passing through the body of refined metal 46 as well as through the slag 34 and through the electrode 24. Such reduction in refining current has the effect of reducing the rate of melting of the electrode 24 at the upper surface of the slag 34 and in this way reducing the rate at which metal accumulates in the cold hearth 40.

When the flow rate of stream 156 is increased, decreased or brought to a stop, such as, for example, through the enlargement of the thickness of the skull 128 in the vertical neck portion of the cold finger apparatus, the liquid metal 46 in the cold hearth, as well as the liquid slag 34 in the slag station, can be kept molten by selectively adjusting a current through the apparatus, in coordination with the requirements for the spray for the preform. However, when the stream is stopped, a sufficiently lower level of current is required, such that the reservoir 46 of molten metal remains molten and the slag bath 34 remains molten but the melting of the electrode at the upper surface of the slag bath 34 proceeds at a very low or negligible level so that the level of molten metal in cold hearth station 40 does not excessively build up.

In operation, as illustrated in FIG. 1, the ingot 24 of unrefined metal is processed in a single pass through the electroslag refining and related apparatus and through the cold hearth station 40 to form a continuous stream 156 of refined metal. The stream 156 formed by the processing is a stream of refined metal free of the oxide, sulfide and other impurities which can be removed by the electroslag refining of station 30.

Depending on the application for the electroslag refining apparatus, there is a need to control the rate at which a metal stream 156 is removed from the cold finger orifice structure 130. The rate at which such a stream of molten metal is drained from the cold hearth through the cold finger structure 180 is, at least partially, controlled by the cross-sectional area of the orifice 130 and by the hydrostatic head of liquid above the orifice. This hydrostatic head is the result of the column of liquid metal and of liquid slag which extends above the orifice of the cold finger structure 180. The flow rate of liquid from the cold finger orifice or nozzle has been determined experimentally for a cylindrical orifice (See U.S. Pat. No. 5,160,532).

If an electroslag refining apparatus, such as that illustrated in FIG. 2, is operated with a given hydrostatic head, a nozzle area can be selected and provided which permits an essentially constant rate of flow of liquid metal from the refining vessel so long as the hydrostatic head above the nozzle is maintained essentially constant. It is believed to be important in the operation of such an apparatus to establish and maintain control of the hydrostatic head, which is essentially constant during steady state operations. To provide such a constant hydrostatic head, it is important that the electroslag refining current flowing through the refining vessel be such that the rate of melting of metal from the ingot such as 24 be continuously adjusted to provide a rate of melting of ingot metal which corresponds to the rate of withdrawal of metal in stream 156 from the refining vessel. With the establishment of such control, maintenance of a constant hydrostatic head of two inches or more can achieved, by means, such as, for example, melt level sensing means.

In other words, one control on the rate at which the metal from ingot 24 is refined in the apparatus of FIG. 1 is determined by the level of refining power supplied to the vessel from a source such as 74 of FIG. 1. A primary control, therefore, in adjusting the rate of ingot melting and, accordingly, the rate of introduction of metal into the refining vessel is the level of power supplied to the vessel.

In general, a steady state is desired in which the rate of metal melted and entering the refining station 30 as a liquid is equal to the rate at which liquid metal is removed as a stream 156 (see FIG. 3) through the cold finger structure and provided to the atomizer 231 for atomization into spray to be formed into a preform. Slight adjustments to increase or decrease the rate of melting of metal are made by adjusting the power delivered to the refining vessel from a power supply such as 74. Also, in order to establish and maintain a steady state of operation of the apparatus, the ingot must be maintained in contact with the upper surface of the body of molten slag 34 and the rate of descent of the ingot into contact with the melt must be adjusted through control means within box 12 to ensure that touching contact of the lower surface of the ingot with the upper surface of the molten slag 34 is maintained.

The deep melt pool 46 within cold hearth station 40 is an advantage in the electroslag refining because a specific flow rate can be established from the reservoir of melt 46 through the flow path 130 (see FIG. 3) from the cold finger apparatus 180.

Generally, control or stoppage of the flow through passageway 130 is accomplished by supplying or withdrawing heat from the melt and essentially increasing or decreasing the size of the skull 128 in the passage way 130 with stoppage occurring with the freezing the metal within the passageway 130. In supplying or withdrawing heat from the melt, it will be appreciated that there are essentially two sources of heat for the metal within passageway 130. One source is heat which is generated in the metal by operation of the coils 135 and 185. The second source is the heat within the melt itself as it flows down from reservoir 46. Although it is possible to stop heating the melt in passageway 130 by stopping the supply of power from power source 137 the metal will remain molten because molten metal is flowing down reservoir 46 to passageway 130 and brings with it the heat of fusion and a degree of superheat already present in the melt.

There are also a number of ways in which heat is removed from melt in passageway 130. A primary source of heat removal and the one which causes the skull 128 to remain in place is the cooling accomplished by flow of water in the cold fingers, such as 100. It is possible to increase or reduce the rate of cooling water flow through the cold fingers in order to increase or decrease the size of the skull 128. Such increase or decrease in the size of the skull 128 will increase or decrease the flow rate of molten metal delivered to the atomization zone. Thus, one method of controlling the gas to metal ratio is to control the size of the skull 128 in passageway 130 to increase or decrease the flow rate of molten metal delivered to the atomization zone 237.

At the lowermost part of vessel 32 a controlled drain orifice 130 communicates with molten metal pool 46. A stream of molten metal 156 is caused to flow from orifice 130 through a spray forming atomizer 231. In one form, atomizer 231 comprises a hollow circular atomizer manifold with a central circular aperture 232 which is concentrically positioned to receive metal stream 156 therethrough. Atomizer 231 also includes a peripheral row of gas jets or orifices 225 in a peripherally continuous tapered or conical edge surface 226. Atomizer 231 is connected to a source (not shown) of an inert gas under pressure, and the combination of the gas jet orifices 225 and conical surface 226 provides a plurality of gas streams 227 which converge at a downstream apex on the passing metal stream 156. The controlled interaction of the gas jet streams 227 with metal stream 156 causes metal stream 156 to break down and be converted to an expanding spray plume or pattern 228 of small molten metal droplets.

Spray pattern 228 is directed against a collector or preform 229 to provide, for example, a billet of refined ingot metal or other ingot metal objects. Collector 229 may be a fixed or moving surface including a rotating surface such as the surface of a rotating cylinder or mandrel. The efficiency and effectiveness of deposition of molten metal spray 228 on a collector surface to provide a refined metal object is facilitated and improved when the spray pattern 228 may be angularly adjusted with respect to the collector. Angular adjustment also leads to improved density and microstructure of the refined metal product. Continuous and repetitive angular adjustment may also be utilized to provide an oscillating or scanning motion of the atomizer 231.

In order to provide angular adjustment, atomizer 231 may be mounted for angular adjustment rotation about a transverse axis so that the plane of the atomizer is not perpendicular to the metal stream 156. Also, by mounting atomizer 231 for angular adjustment rotation, the defined spray pattern 228 may be more advantageously matched to different surface configurations of collector or preform 229 as compared to a non-adjustable atomizer where the spray pattern is fixedly directed to a limited area of the collector, a condition which may require a complex adjustable mounting of a collector which, for example, may weigh from about 50 lbs. to about 15 tons.

One simple and convenient adjustable mounting for atomizer 231 may comprise a pair of diametrically opposed radially extending stub shafts 210 only one of which is shown in FIG. 6 with atomizer 231 therebetween.

The molten metal stream 156 passes through an atomizer 231 for conversion into a molten metal plume or spray pattern 228 (FIG. 2). As illustrated, the atomizer 231 is angularly adjustable about a transverse axis so that it is tilted from its horizontal position, from the viewer's perspective. Maximum adjustment angle is achieved without interference between the atomizer and the passing molten metal stream because of the elongated aperture 213 in atomizer 231 which permits an increased angular adjustment over a circular atomizer. The oval or elliptical aperture 213 provides ample clearance for molten metal stream 156 to provide a gas jet impact or atomization zone 217 for a molten metal spray pattern 228 of increased angular adjustment or deflection.

A major elongation is not required to obtain the benefits of increasing the angle of adjustment without ring/metal stream interference. Consequently the atomizer used, in the illustration of the present invention, provides maximum advantage where the space available may be at a minimum. The oval or elliptical atomizer 231 (FIG. 2) is supported for angular adjustment rotation about the minor axis of an elliptical aperture 232, i.e. across the illustrated shaft supports (not shown) to take maximum advantage of the extended range of adjustment provided by the elliptical configuration of aperture 232. Various rotational adjustment means may be attached to one or both shafts (not shown) for remote electrical or mechanical operation.

The above configuration provided an improved spray forming atomizing for converting a molten metal stream, passing through the atomizer, into a molten metal spray 228. An elongated aperture in the atomizer provided increased angular adjustment of the spray pattern for increased spray 228 deposition effectiveness. Ovate and other elongated aperture configurations may be considered to have major and minor transverse axis dimensions, one of which is longer than the other resulting in what may be defined as providing more clearance, in one direction for the passing metal stream than in the same direction if the atomizer were axially rotated 90°. Details of the spray forming of a preform including systems and methods for controlling the molten metal flow rate are contained in copending patent applications U.S. Pat. No. 5,649,992 and Ser. No. 08/537,966 both assigned to the assignee of the present invention, the disclosure of each is herein incorporated by reference.

One of the critical components of the ESR/CIG melting system is the copper segments of the cold-walled-induction guide tube 80. The funnel shaped cold-walled-induction guide tube 80 is made of at least several copper segments that result from forming slots in an otherwise axisymmetric copper funnel. These slots or gaps 94 are provided in order to avoid melting the copper funnel itself as a result of the surrounding induction coils 135, 185.

When the ESR-CIG system is started, the copper fingers or segments 97, 92 of the cold-induction guide 80 experience a high level of thermal and mechanical strain as a result of the onrush of liquid metal. This strain has resulted in dimensional changes in the orifice 130 of the cold-induction guide 80 and has been found to be unacceptable for adequate control of the melt flow rate or pouring rate of the molten metal in stream 156 from the orifice 130. (See FIG. 2)

In order to control the size of the orifice 130, a retaining ring 510 has been added to the outer surface of the CIG nozzle for preventing strain related dimensional changes. The retaining ring 510 may comprise any non-conductive material, such as fiberglass, plastic, thermosetting resin, epoxy, thermoplastic, nylon, etc. An optional fiber reinforced composite material in addition to the non-conductive material, may be necessary to achieve-the overall required stiffness.

Figure 5A:
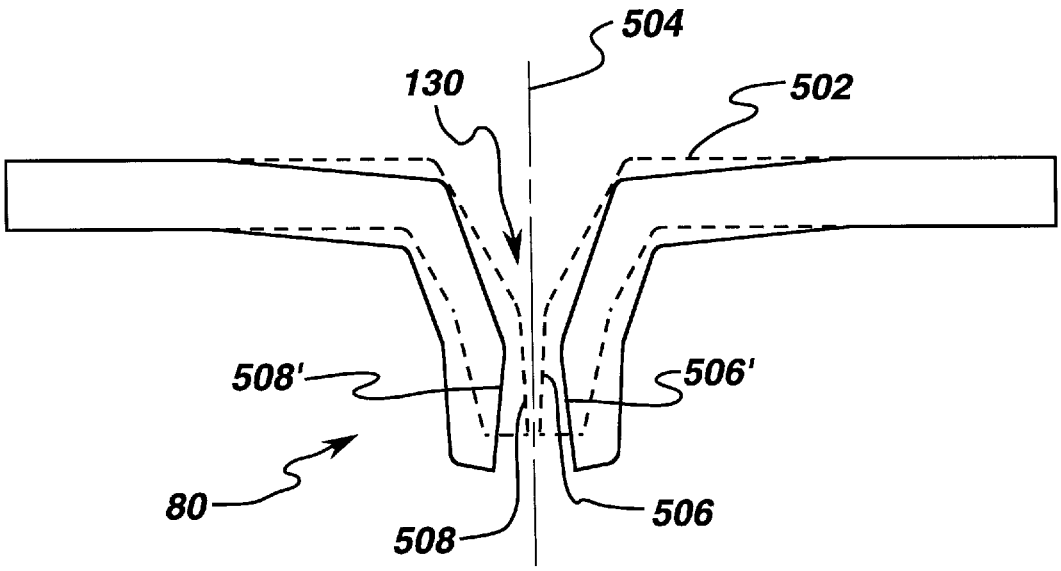
FIG. 5*a* is a semischematic illustration of the various positions of the copper funnel resulting from expansion/contraction thermal and mechanical conditions exaggerated for ease of illustration.

Normally, the orifice walls are positioned as shown by dotted lines 502 (FIG. 5*a*) with the opening 130 between the internal dotted lines along nozzle orifice opening center line 504. It has been found that when starting the ESR-CIG system, the relative inner dimensions of the opening 130 are changed, due to the thermal and mechanical strain associated with the hot liquid metal interacting with the copper, cold wall induction guide fingers. The original internal surfaces 506, 508 are repositioned to positions 506', 508' thereby changing the dimensions of the internal opening 130 along center line 504. This dimensional change has resulted in the inability to accurately control the melt flow rate or pouring rate of the molten metal in a stream from the orifice or opening 130. Once the dimensional changes in the copper segments was determined to be relatively uncontrollable, means, such as for example, a retaining ring 510 were positioned about the outer surfaces 512 and 514 of the cold induction guide 80.

Figure 5B:
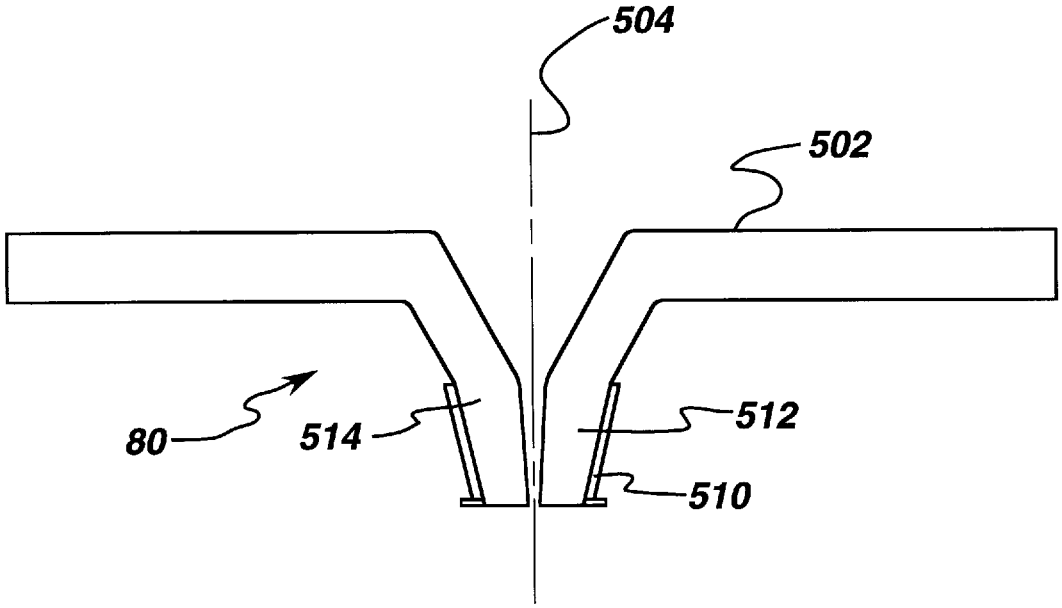
FIG. 5*b*; is a semischematic illustration of the cooper funnel of FIG. 5*a* including the present invention.

One possible configuration is illustrated in FIG. 5*b*. The system as illustrated has been successfully implemented in a ESR/CIG system, resulting in substantially improved performance of the CIG unit. In one embodiment, a several layers of glass fiber in sufficient tension of about one quarter (25%) of the breaking strength of the glass fiber was wrapped around the bottom of the CIG and held in position by an epoxy filler. The glass fiber should be of sufficient width that the CIG is retained in position and its dimensions are maintained within acceptable elasticity limits and is shielded from the heat radiation from the metal stream.

While the systems and methods contained herein constitute preferred embodiments of the invention, it is to be understood that the invention is not limited to these precise systems and methods, and that changes may be made therein without departing from the scope of the invention which is defined in the appended claims.

What is claimed is:

1. An apparatus for dispensing refined metal as a liquid melt comprising:

a plurality of guide fingers circumferentially adjoining at separating gaps therebetween to define a downspout having a central orifice for dispensing therethrough said melt;

means for transmitting induction heating energy through said gaps and into said orifice;

means for cooling said guide fingers; and means surrounding said orifice for retaining said guide fingers against dimensional change in diameter of said orifice.

2. An apparatus according to claim 1 wherein said retaining means comprise a ring fixedly joined to said guide fingers.

3. An apparatus according to claim 2 wherein said retaining ring circumferentially surrounds said guide fingers.

4. An apparatus according to claim 3 wherein said retaining ring is disposed radially between said guide fingers and said transmitting means.

5. An apparatus according to claim 3 wherein said retaining ring comprises a fiber surrounding said guides fingers to provide circumferential stiffness.

6. An apparatus according to claim 5 wherein said retaining ring comprises a plurality of layers of said fiber in tension.

7. An apparatus according to claim 3 further comprising means for electroslag refining an ingot electrode to produce said melt atop said guide fingers.

8. An apparatus according to claim 7 further comprising means disposed below said downspout in flow communication with said orifice for spray atomizing said melt dispensed therefrom.

9. A method of refining an ingot comprising:

electroslag refining said ingot to produce a refined liquid melt therefrom;

collecting said melt atop a cold wall induction guide nozzle having a plurality of guide fingers circumferentially adjoining at separating gaps therebetween to define a downspout having a central orifice for dispensing therethrough said melt; and externally retaining together said guide fingers against dimensional change in diameter of said orifice as said melt is dispensed therethrough by surrounding said orifice with retaining means.

10. A method according to claim 9 wherein said guide fingers are circumferentially joined together around said orifice for maintaining substantially constant said orifice diameter as said melt is dispensed therethrough.

11. A method according to claim 10 further comprising transmitting induction heating energy radially inwardly through said gaps.

12. A method according to claim 10 further comprising spray atomizing said melt dispensed from said orifice using an atomizing gas.

13. A method according to claim 12 further comprising maintaining substantially constant a rate of delivery of said atomizing gas; and varying flow rate of said melt dispensed from said orifice to vary a gas-to-metal ratio thereof.

14. A method according to claim 10 further comprising starting said method by retaining together said guide fingers against thermal and mechanical strain due to initial onrush of said melt through said drain orifice to maintain said substantially constant diameter thereof.

* * * * *